US009869958B2

(12) United States Patent
Tanigami et al.

(10) Patent No.: US 9,869,958 B2
(45) Date of Patent: Jan. 16, 2018

(54) IMAGE FORMING APPARATUS THAT CONTROLS MOVEMENT OF A CONTINUOUS SHEET THROUGH A FIXING UNIT

(71) Applicant: KONICA MINOLTA, INC., Chiyoda-ku, Tokyo (JP)

(72) Inventors: Shinya Tanigami, Hachioji (JP); Shingo Sasami, Hino (JP); Shougo Fukai, Hino (JP); Hideo Yamane, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/477,759

(22) Filed: Sep. 4, 2014

(65) Prior Publication Data

US 2015/0078771 A1 Mar. 19, 2015

(30) Foreign Application Priority Data

Sep. 13, 2013 (JP) ..... 2013-190983

(51) Int. Cl.
*G03G 15/00* (2006.01)
*G03G 15/20* (2006.01)

(52) U.S. Cl.
CPC ..... *G03G 15/6529* (2013.01); *G03G 15/652* (2013.01); *G03G 15/2067* (2013.01);
(Continued)

(58) Field of Classification Search
CPC ..... G03G 15/2085; G03G 15/2078; G03G 15/2067; G03G 15/164; G03G 15/6526;
(Continued)

(56) References Cited

U.S. PATENT DOCUMENTS 4,044,228 A * 8/1977 Kishimoto ..... G06F 15/02 101/93.07
4,297,716 A * 10/1981 Hirayama et al. ..... 347/139
(Continued)

FOREIGN PATENT DOCUMENTS

JP 60218680 A 11/1985
JP 03069980 A 3/1991
(Continued)

OTHER PUBLICATIONS

English machine translation of Yokota (JP 03-238472 A); by Yokota, Yuji; "Electrophotographic Recorder Using Continuous Paper"; published Oct. 24, 1991.*
(Continued)

*Primary Examiner* — David M Gray
*Assistant Examiner* — Geoffrey T Evans
(74) *Attorney, Agent, or Firm* — Holtz, Holtz & Volek PC

(57) ABSTRACT

An image forming apparatus of the present invention includes: an image forming unit for forming an image on a continuous paper; a fixing unit for fixing by heat the image which has been formed on the continuous paper by the image forming unit; conveyance units for conveying the continuous paper; and a control unit for controlling the conveyance units to convey the continuous paper in such a manner that, when an image forming operation by the image forming unit is stopped, the same portion of the continuous paper, on which the image is not formed, does not remain in the fixing unit for a predetermined period of time.

33 Claims, 9 Drawing Sheets

(52) U.S. Cl.
CPC ..... *G03G 15/2085* (2013.01); *G03G 15/6517* (2013.01); *G03G 15/6526* (2013.01); *G03G 2215/00455* (2013.01); *G03G 2215/00603* (2013.01)

(58) Field of Classification Search
CPC ..... G03G 2215/00455; G03G 15/6517; G03G 15/652; G03G 2215/00223
USPC ..... 399/45, 67, 68, 122, 322, 332, 375, 384
See application file for complete search history.

(56) References Cited

U.S. PATENT DOCUMENTS

| | | | | |
|---|---|---|---|---|
| 5,087,947 | A | 2/1992 | Torino | |
| 5,099,290 | A | 3/1992 | Yokota | |
| 5,481,352 | A * | 1/1996 | Yamamoto et al. | 399/384 |
| 5,905,930 | A * | 5/1999 | Toyama et al. | 399/299 |
| 5,956,554 | A | 9/1999 | Yanashima et al. | |
| 6,339,692 | B2 * | 1/2002 | Yoshida | 399/384 |
| 6,728,497 | B2 | 4/2004 | Masuda et al. | |
| 2002/0031361 | A1 * | 3/2002 | Shiiya | G03G 15/2032 399/68 |
| 2011/0229183 | A1 * | 9/2011 | Seki | G03G 15/50 399/82 |
| 2013/0177332 | A1 * | 7/2013 | Saito | G03G 15/2021 399/92 |
| 2015/0063846 | A1 * | 3/2015 | Fukai | G03G 15/2067 399/45 |
| 2015/0241821 | A1 * | 8/2015 | Fukai | G03G 15/205 399/70 |

FOREIGN PATENT DOCUMENTS

| | | | |
|---|---|---|---|
| JP | 03238472 | A | 10/1991 |
| JP | 08262898 | A | 10/1996 |
| JP | 09160424 | A | 6/1997 |
| JP | 2002328560 | A | 11/2002 |
| JP | 2009166916 | A | 7/2009 |
| JP | 2011033977 | A * | 2/2011 |

OTHER PUBLICATIONS

Japanese Office Action (and English translation thereof) dated Sep. 1, 2015, issued in counterpart Japanese Application No. 2013-190983.

* cited by examiner

IMAGE FORMING APPARATUS THAT CONTROLS MOVEMENT OF A CONTINUOUS SHEET THROUGH A FIXING UNIT

CROSS-REFERENCE TO RELATED APPLICATION

This application is based on Japanese Patent Application No. 2013-190983 filed on Sep. 13, 2013, the contents of which are incorporated herein by reference.

BACKGROUND

1. Technical Field

The present invention relates to an image forming apparatus, an image forming system, an image forming method, and a non-transitory computer readable recording medium stored with an image forming program.

2. Description of Related Art

Conventionally, there has been an image forming apparatus capable of using a continuous paper (including a roll paper) as a recording medium. In such an image forming apparatus, when the continuous paper is conveyed to a position of an image forming unit, a toner image formed in the image forming unit is transferred to the continuous paper. After that, the continuous paper is conveyed to a position of a fixing device, the toner is melted by heating, and thereby fixing the toner image on the continuous paper.

Therefore, the continuous paper is conveyed according to the image forming operation described above, and is controlled so as not to be conveyed while the image forming operation is stopped.

At this time, the fixing device continuously heats the continuous paper even while conveyance of the continuous paper is stopped. Because of this, when a stop time of conveying the continuous paper becomes long, heat is concentrated on a local part of the continuous paper, and thermal alteration, such as burn, may be generated.

Consequently, in order to prevent thermal alteration on the continuous paper, a fixing device in which, while conveyance of a continuous paper is stopped, nip of the continuous paper by a fixing roller serving as a heat source is released and the fixing roller is separated from the continuous paper, has been developed (e.g., Japanese Patent Application Laid-Open Publication No. H09-160424).

However, due to lack of space where the fixing device is installed, there is a limit to a distance of the fixing roller separated from the continuous paper. As a result, even if the fixing roller is separated from the continuous paper while the conveyance of the continuous paper is stopped, some heat may be transferred to the continuous paper. In a case where the stop time of conveying the continuous paper is further increased, this cannot prevent thermal alteration of the continuous paper.

SUMMARY

The present invention is made in consideration of the above-described situation, and an object thereof is to provide an image forming apparatus, an image forming system, an image forming method, and an image forming program, in which local thermal alteration of a continuous paper is prevented more reliably.

To achieve at least one of the abovementioned objects, an image forming apparatus reflecting one aspect of the present invention includes: an image forming unit configured to form an image on a continuous paper; a fixing unit configured to fix by heat the image which has been formed on the continuous paper by the image forming unit; conveyance units configured to convey the continuous paper; and a control unit configured to control the conveyance units to convey the continuous paper in such a manner that, when an image forming operation by the image forming unit is stopped, a same portion of the continuous paper, on which the image is not formed, does not remain in the fixing unit for a predetermined period of time.

Further, in the above-described image forming apparatus, it is desirable that the control unit convey the continuous paper for every predetermined period of time.

Further, in the above-described image forming apparatus, it is desirable that the control unit continuously convey the continuous paper.

Further, in the above-described image forming apparatus, it is desirable that the fixing unit have a roller which abuts the continuous paper and fixes the image to the continuous paper by applying pressure and that the abutment of the roller be released after a stop of the image forming operation by the image forming unit.

Further, in the above-described image forming apparatus, it is desirable that the roller be rotated in a state in which the abutment of the roller on the continuous paper is released.

Further, in the above-described image forming apparatus, it is desirable that after the stop of the image forming operation by the image forming unit, the fixing unit stop heating or adjust a temperature by lowering to a target temperature.

Further, in the above-described image forming apparatus, it is desirable that the control unit change at least one of a time interval of periodically conveying the continuous paper, a conveyance speed of the continuous paper, and a temperature of the fixing unit after the stop of the image forming operation according to at least any of a type and a basis weight of the continuous paper.

Further, in the above-described image forming apparatus, it is desirable that the control unit lower the temperature of the fixing unit to a predetermined temperature after the stop of the image forming operation, or when a predetermined period of time elapses, stop the continuous or periodic conveyance of the continuous paper, or increase the time interval of periodically conveying the continuous paper.

Further, in the above-described image forming apparatus, it is desirable that the control unit convey the continuous paper to the conveyance units by switching a conveyance direction of the continuous paper between a feeding direction of the continuous paper at the time of image formation by the image forming unit and a direction reverse to the feeding direction.

Further, in the above-described image forming apparatus, it is desirable that the conveyance units convey the continuous paper by a configuration which is not included in the fixing unit.

The objects, features, and characteristics of this invention other than those set forth above will become apparent from the description given herein below with reference to preferred embodiments illustrated in the accompanying drawings.

DETAILED DESCRIPTION

Figure 1:
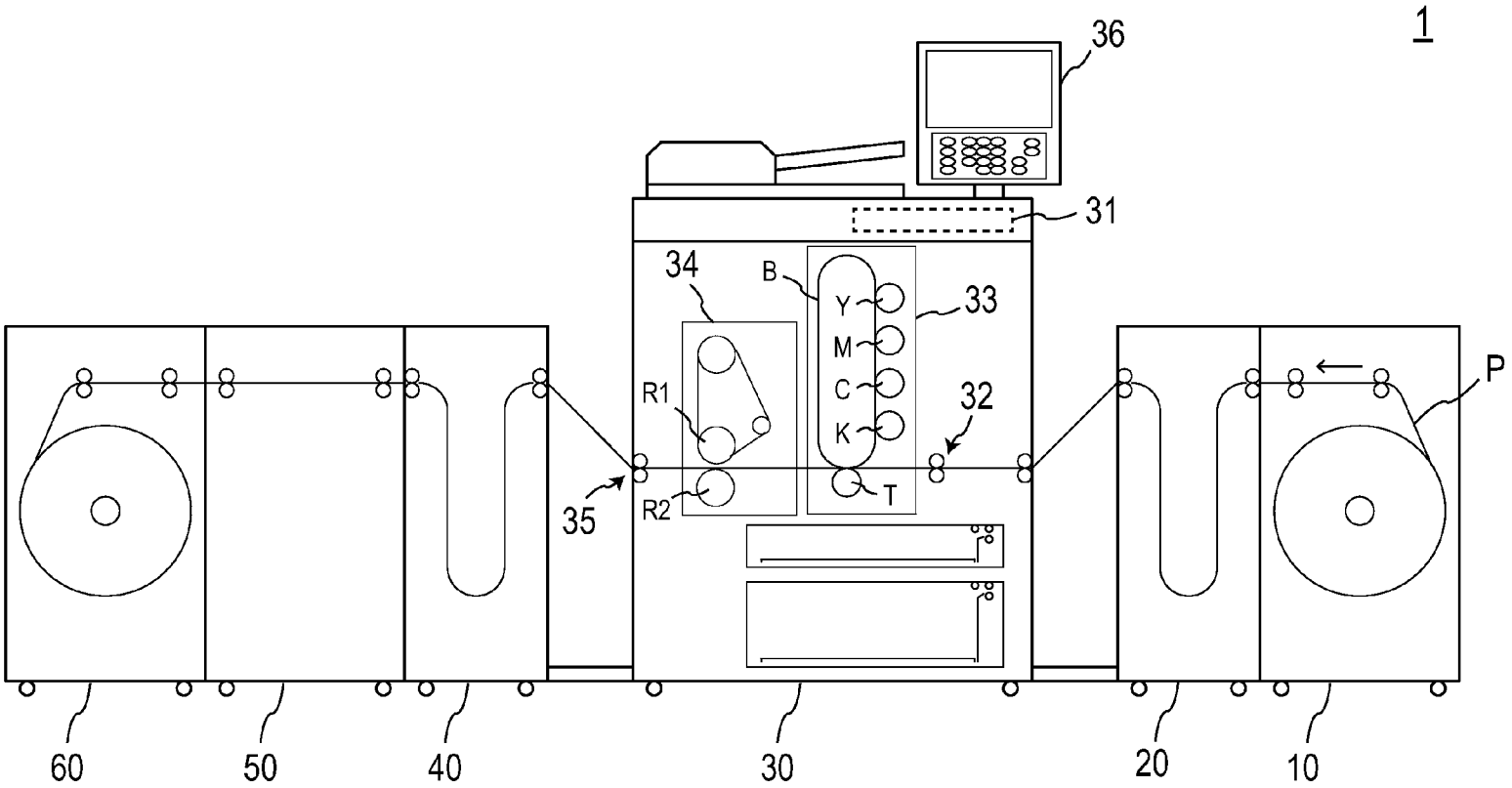
FIG. 1 is a diagram illustrating a schematic configuration example of an image forming system according to a present embodiment.

The embodiments of this invention will be described below with reference to the accompanying drawings. It should be noted that the same components are denoted by the same reference numerals in description of the drawings, and redundant description thereof is omitted. Further, dimension ratios in the drawings are exaggerated for convenience of explanation and are different from actual ratios in some cases.

FIG. 1 is a diagram illustrating a schematic configuration example of an image forming system according to a present embodiment.

With reference to FIG. 1, a schematic configuration of an image forming system 1 will be described below.

<Image Forming System 1>

The image forming system 1 according to the present embodiment is a system where a continuous paper (including a roll paper) is used as a recording medium and an image is formed on the continuous paper.

As illustrated in FIG. 1, the image forming system 1 is configured by connecting a paper feeding apparatus 10, a paper feeding adjustment apparatus 20, an image forming apparatus 30, a paper discharging adjustment apparatus 40, a processing apparatus 50, and a paper discharging apparatus 60 from an upstream side in a conveyance direction of the continuous paper.

The paper feeding apparatus 10 is an apparatus for feeding a continuous paper P to the image forming apparatus 30. As illustrated in FIG. 1, within a casing of the paper feeding apparatus 10, for example, the roll-shaped continuous paper P is wound around a support shaft and held rotatably. The paper feeding apparatus 10 conveys the continuous paper P, which has been wound around the support shaft, at a constant speed to outside via a plurality of rollers (e.g., a delivery roller and a paper feeding roller). However, in the paper feeding apparatus 10, the continuous paper P does not necessarily need to be held in the roll shape, and may be held in a folded state. Further, only one continuous paper P is illustrated in FIG. 1, but a plurality of continuous papers may be held.

The paper feeding adjustment apparatus 20 is installed on a downstream side of the paper feeding apparatus 10 and an upstream side of the image forming apparatus 30 in the conveyance direction of the continuous paper P. The paper feeding adjustment apparatus 20 conveys the continuous paper P conveyed from the paper feeding apparatus 10 to the image forming apparatus 30. However, as illustrated in FIG. 1, in order to absorb a speed difference between a conveyance speed of the continuous paper P in the paper feeding apparatus 10 and a conveyance speed of the continuous paper P in the image forming apparatus 30, the paper feeding adjustment apparatus 20 loosely holds the continuous paper P and adjusts feeding of the continuous paper P to the image forming apparatus 30.

The image forming apparatus 30 has a printing function. The image forming apparatus 30 is installed on a downstream side of the paper feeding adjustment apparatus 20 and an upstream side of the paper discharging adjustment apparatus 40 in the conveyance direction of the continuous paper P. As illustrated in FIG. 1, the image forming apparatus 30 includes a control unit 31, a paper feed conveyance unit 32, an image forming unit 33, a fixing unit 34, a paper discharge conveyance unit 35, and an operation panel 36.

The control unit 31 controls the respective units 32 to 35 included in the image forming apparatus 30 and causes the units to execute an operation of forming an image on the continuous paper P (also referred "image forming operation" hereinafter).

The paper feed conveyance unit 32 is a conveyance mechanism on a paper feeding side of the image forming apparatus 30. For example, a pair of paper feed conveyance rollers is rotated by driving of a paper feeding motor, and the continuous paper P conveyed from the paper feeding adjustment apparatus 20 is conveyed to the image forming unit 33.

The image forming unit 33 forms a toner image according to an electrophotographic process, and transfers the image to the continuous paper P. For example, in the image forming unit 33, photosensitive drums (Y, M, C, and K) and an intermediate transfer belt B are used as image carriers. The intermediate transfer belt B is an endless belt, and is wound around and supported by a plurality of rollers so as to be travelable. Toner images of respective colors formed on the photosensitive drums (Y, M, C, and K) are successively transferred onto the intermediate transfer belt B, and a toner image (color image), on which layers of the respective colors (Y, M, C, and K) have been superimposed, is formed on the intermediate transfer belt B. Then, the toner image formed on the intermediate transfer belt B is transferred onto the continuous paper P by applying to a transfer roller T bias of a polarity reverse to that of the toner.

The fixing unit 34 fixes the toner image transferred onto the continuous paper P. For example, the fixing unit 34 causes a fixing roller R1 serving as a heating source to pressure-bond to a pressurizing roller R2. With this configuration, heat and pressure are applied to a nip portion, and the toner image is melted and fixed to the continuous paper P.

The paper discharge conveyance unit 35 is a conveyance mechanism on a paper discharging side of the image forming apparatus 30. For example, a pair of paper discharge conveyance rollers is rotated by driving of a paper discharging motor, and the continuous paper P passed through the fixing unit 34 is conveyed to the paper discharging adjustment apparatus 40.

The operation panel 36 includes a touch panel, ten keys, a start button, a stop button, and the like, and is used for displaying various information and inputting various instructions.

It should be noted that the image forming apparatus 30 may be an MFP (Multi-Function Peripheral) having a copy function, a scan function, a facsimile function, and the like in addition to the printing function.

The paper discharging adjustment apparatus 40 is installed on a downstream side of the image forming apparatus 30 and an upstream side of the processing apparatus 50 in the conveyance direction of the continuous paper P. The paper discharging adjustment apparatus 40 conveys the continuous paper P conveyed from the image forming apparatus 30 to the processing apparatus 50. However, as illustrated in FIG. 1, in order to absorb a speed difference between the conveyance speed of the continuous paper P in the image forming apparatus 30 and a conveyance speed of the continuous paper P in the processing apparatus 50, the paper discharging adjustment apparatus 40 loosely holds the continuous paper P and adjusts discharging of the continuous paper P from the image forming apparatus 30.

The processing apparatus 50 performs cutting off of the continuous paper P into a predetermined shape, lamination processing thereon, and the like.

The paper discharging apparatus 60 is an apparatus for discharging the continuous paper P conveyed from the image forming apparatus 30 via the paper discharging adjustment apparatus 40 and the processing apparatus 50. As illustrated in FIG. 1, within a casing of the paper discharging apparatus 60, for example, the continuous paper P is wound around a support shaft and held in a roll shape. Because of this, the paper discharging apparatus 60 winds the continuous paper P, which has been conveyed from the processing apparatus 50, around the support shaft at a constant speed via a plurality of rollers (e.g., a delivery roller and a paper discharge roller). However, in the paper discharging apparatus 60, the continuous paper P does not necessarily need to be held in the roll shape, and may be cut for every page.

<Control Unit 31 (Hardware Configuration)>

Figure 2:
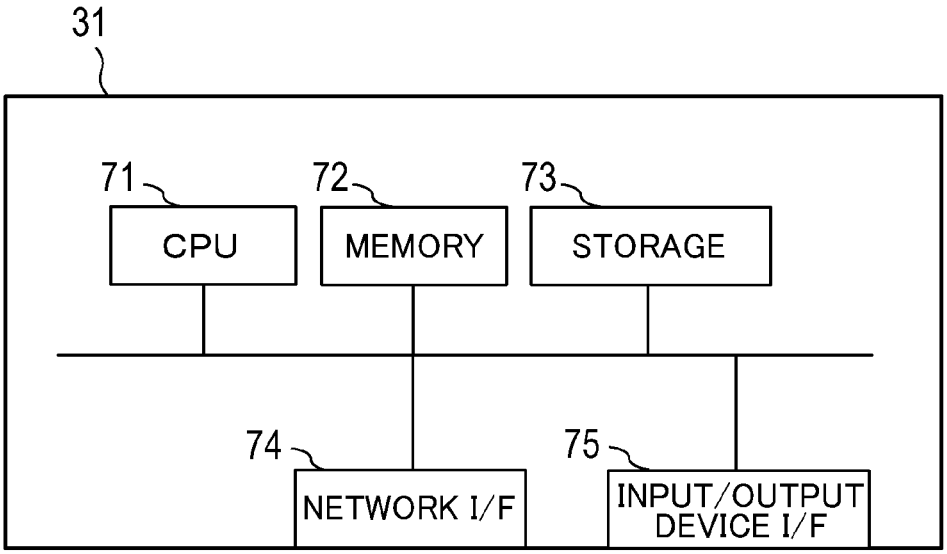
FIG. 2 is a block diagram illustrating a hardware configuration example of a control unit.

FIG. 2 is a block diagram illustrating a hardware configuration example of a control unit.

With reference to FIG. 2, a hardware configuration of a control unit 31 will be described below.

As illustrated in FIG. 2, the control unit 31 has a CPU (Central Processing Unit) 71, a memory 72, a storage 73, a network interface (I/F) 74, and an input/output device interface (I/F) 75. These are mutually connected via buses for exchanging signals.

The CPU 71 is a control circuit constituted of a multicore processor or the like which executes controls of the above-described parts and various arithmetic processing according to a program. Each function of the image forming system 1 is exhibited as the CPU 71 executes a program corresponding thereto.

The memory 72 is a main storage device which temporarily stores a program and data as a working area and is capable of performing high speed access. For example, a DRAM (Dynamic Random Access Memory), a SDRAM (Synchronous Dynamic Random Access Memory), a SRAM (Static Random Access Memory), and the like are employed for the memory 72.

The storage 73 is a large capacity auxiliary storage device which stores various programs including an operating system and various data. For example, a flash memory, a solid state drive, a hard disk, a ROM (Read Only Memory), and the like are employed for the storage 73.

The network I/F 74 is an interface for communicating with other external devices (e.g., a host device incorporated with a printer driver) via a computer network. Standards, such as Ethernet (registered trademark), Wi-Fi, FDDI, and Token Ring, are used for the communication.

The input/output device I/F 75 is, for example, an interface for communicating with an input device, such as the operation panel 36, and an output device.

The control unit 31 of the present embodiment has the above-described hardware configuration. By this hardware configuration, when the image forming operation by the image forming unit 33 is stopped, the control unit 31 controls the paper discharge conveyance unit 35 and the like to control conveyance of the continuous paper P in such a manner that the same portion of the continuous paper P, on which an image is not formed, does not remain in the fixing unit 34 for a predetermined period of time.

A detailed operation of the image forming system 1 (particularly, the control unit 31) will be described below in detail.

<Operation of Image Forming System 1>

Figure 3:
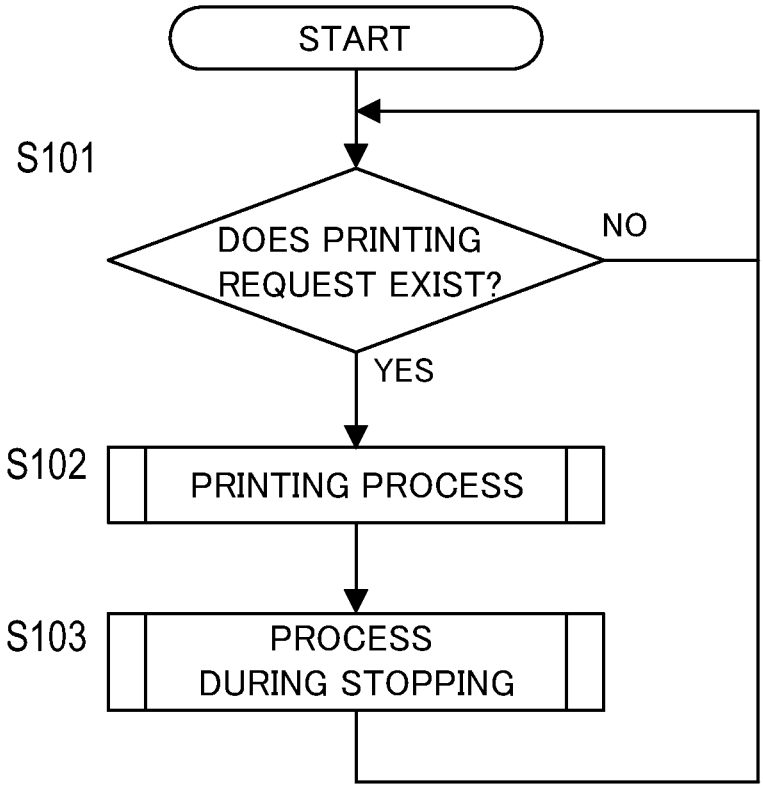
FIG. 3 is a flowchart illustrating a procedure of a printing request receiving process.
Figure 4:
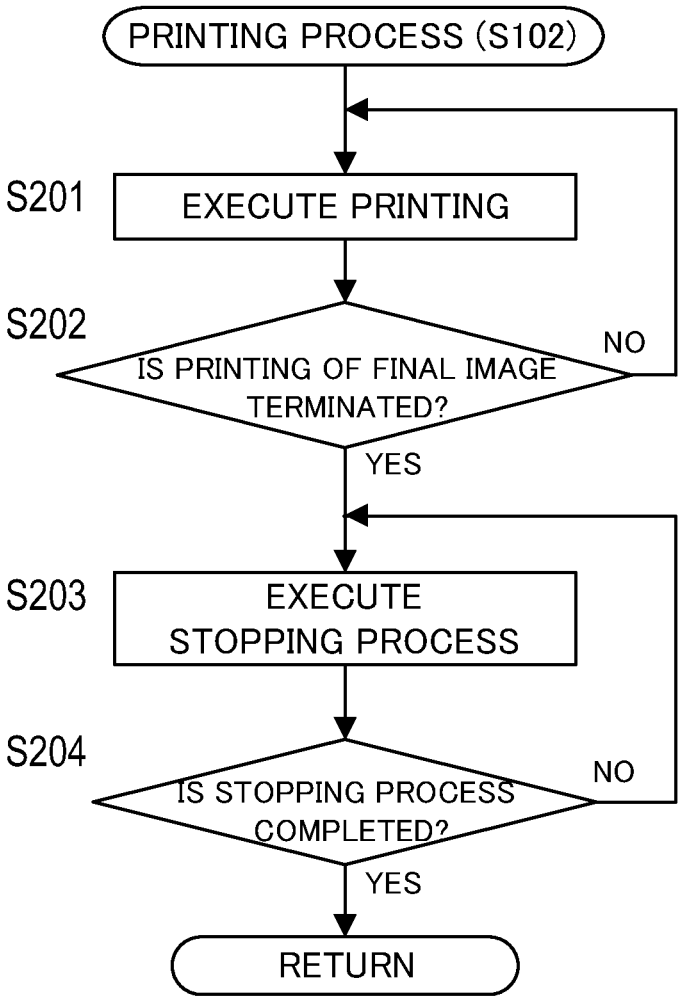
FIG. 4 is a flowchart illustrating a procedure of a printing process.
Figure 5:
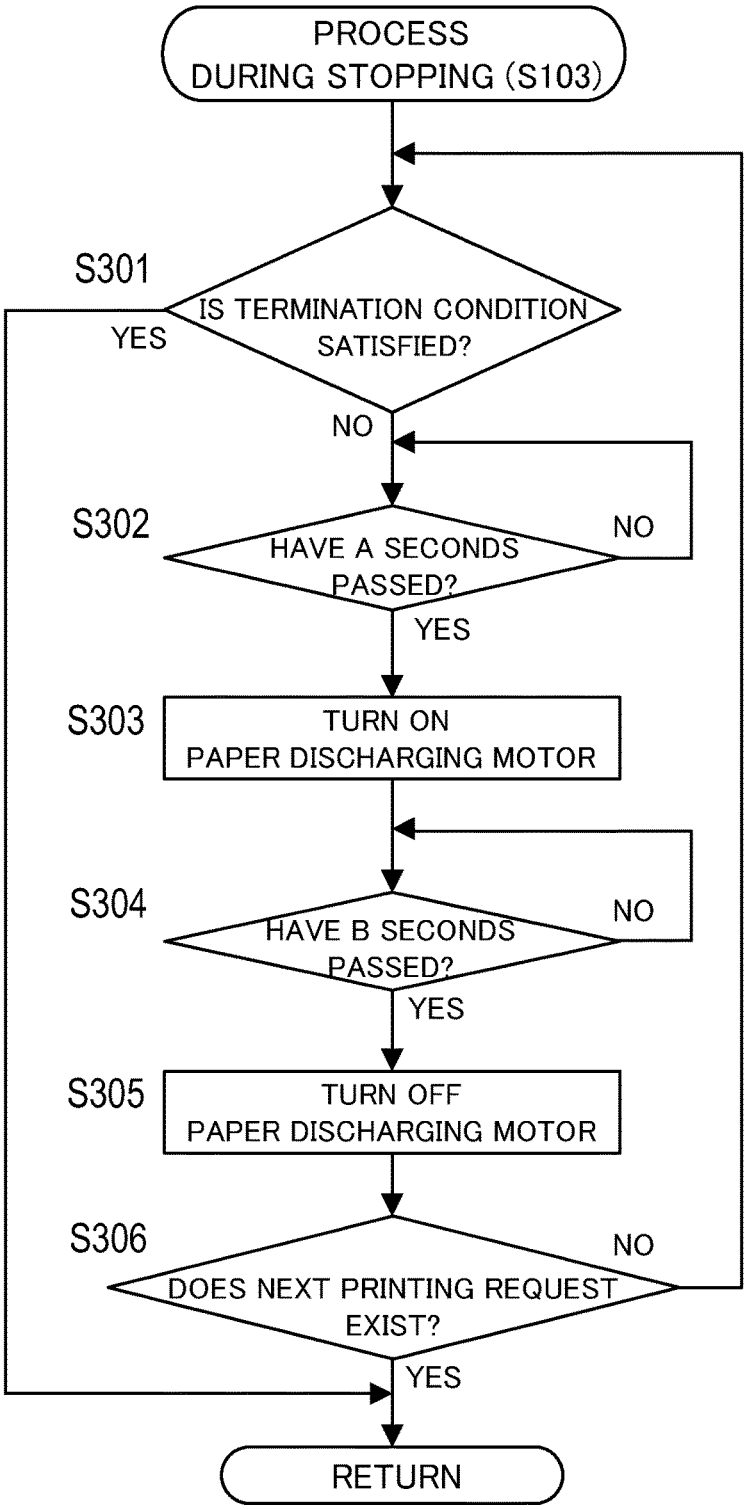
FIG. 5 is a flowchart illustrating a procedure of a process during stopping.
Figure 6:
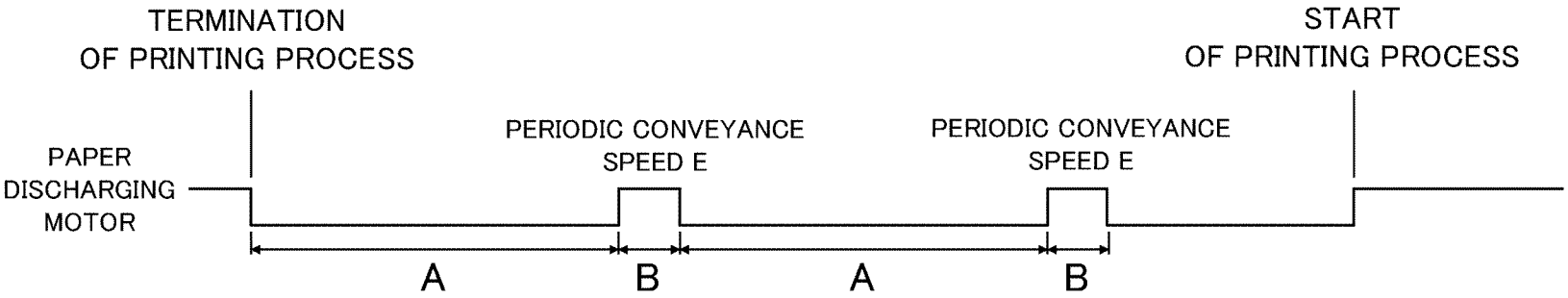
FIG. 6 is a diagram for explaining about a conveying method of a continuous paper in the process during stopping.
Figure 7:
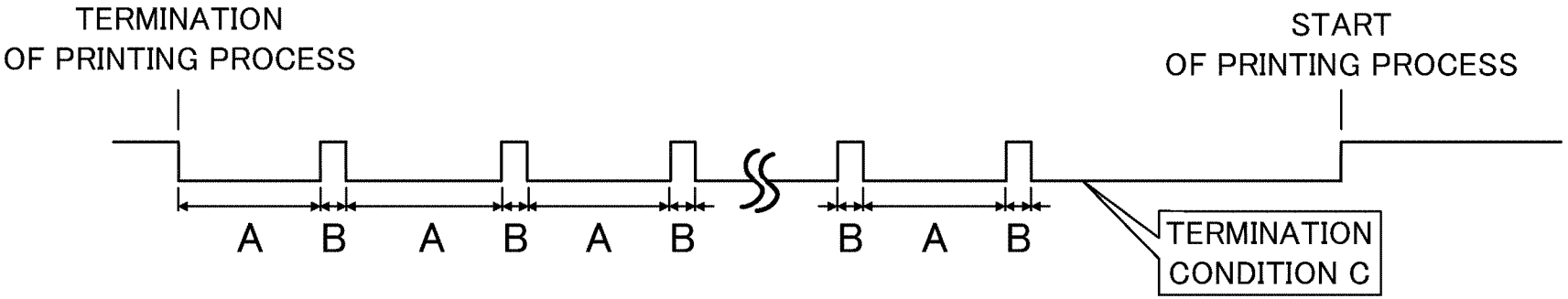
FIG. 7 is a diagram for explaining about a termination condition of the process during stopping.

FIG. 3 is a flowchart illustrating a procedure of a printing request receiving process. FIG. 4 is a flowchart illustrating a procedure of a printing process. FIG. 5 is a flowchart illustrating a procedure of a process during stopping. FIG. 6 is a diagram for explaining about a conveying method of a continuous paper in the process during stopping. FIG. 7 is a diagram for explaining about a termination condition of the process during stopping.

First, the procedure of the printing request receiving process will be described with reference to FIG. 3.

(Printing Request Receiving Process)

For example, when a power source of a main body is turned on, the printing request receiving process illustrated in FIG. 3 is started. However, a timing at which the printing request receiving process is started is not limited to this. The printing request receiving process may be started when an operation for starting the printing request receiving process is performed on the operation panel 36.

[Step S101]

When the printing request receiving process is started, the control unit 31 discriminates existence of the printing request. For example, if the control unit 31 receives a printing job from an external device (such as a host device incorporated with a printer driver) via the network I/F 74, the control unit 31 determines that the printing request exists. However, the printing request is not limited to this. For example, if a paper document is mounted on an ADF (Auto Document Feeder) or a platen and an operation for a copy instruction is performed on the operation panel 36, it may be determined that the printing request exists. On the other hand, if the printing job is not received or if the copy instruction does not exist, the control unit 31 determines that the printing request does not exist.

The control unit 31 repeats the discrimination process in step S101 until the printing request is made (step S101: NO). On the other hand, if the printing request is made (step S101: YES), the control unit 31 advances the process to step S102.

[Step S102]

The control unit 31 executes the printing process. For example, the control unit 31 executes printing (image formation) based on the printing job received in step S101 on the continuous paper P. Alternatively, the control unit 31 executes printing based on the paper document, which has been subjected to the copy instruction in step S101. Then, after the printing process is finished, the control unit 31 advances the process to step S103. Details of the printing process will be described later.

[Step S103]

The control unit 31 executes the process during stopping. For example, the control unit 31 controls the paper feed conveyance unit 32 and the paper discharge conveyance unit 35 to convey the continuous paper P in such a manner that the same portion of the continuous paper P, on which the image is not formed, does not remain in the fixing unit 34 for a predetermined period of time. Then, if a termination condition of the process during stopping is satisfied, the control unit 31 terminates the process during stopping and returns the process to step S101. Details of the process during stopping will be described later.

By executing the above-described printing request receiving process in the image forming apparatus 30, the printing process can be executed according to the existence of the printing request. Further, by executing the process during stopping after the stop of the printing process, the same portion of the continuous paper P, on which the image is not formed, does not remain in the fixing unit 34 for a predetermined period of time. As a result, the continuous paper P is conveyed before a certain amount or more of heat is applied to the same portion of the continuous paper P, and local thermal alteration of the continuous paper P can be reliably prevented.

Next, the procedure of the printing process will be described with reference to FIG. 4.

(Printing Process S102)

As mentioned above, when the process proceeds to step S102 of the printing request receiving process, the control unit 31 starts the printing process.

[Step S201]

When the printing process is started, the control unit 31 executes printing. For example, if the printing job is received in step S101, the control unit 31 extracts print target data included in the printing job. Then, the control unit 31 controls the image forming unit 33 to form the toner image based on the print target data on the photosensitive drums (Y, M, C, and K) of the respective colors and to transfer the toner image to the continuous paper P via the intermediate transfer belt B. With this image forming operation, the control unit 31 at least controls the paper feed conveyance unit 32 and the paper discharge conveyance unit 35 and conveys the continuous paper P. With this configuration, the toner image (image) based on the print target data is formed on the continuous paper P. Subsequently, the image formed on the continuous paper P is conveyed to a position of the fixing unit 34, and heat and pressure are applied thereto by the fixing roller R1 and the pressurizing roller R2 of the fixing unit 34. As a result, the toner image (image) based on the print target data is melted and fixed to the continuous paper P. It should be noted that if the copying is instructed in step S101, the control unit 31 can scan the paper document mounted on the ADF or the platen and print a generated scan image as the print target data according to an operation similar to the above-described operation.

Further, if the plurality of printing jobs is continuously received in step S101 or if the print target data includes data of a plurality of pages, the control unit 31 forms an image on the continuous paper P for every page.

[Step S202]

The control unit 31 discriminates whether printing of a final image has been terminated since the start of the image forming operation in step S201. For example, the control unit 31 counts the number of pages of the image formed on the continuous paper P, and when the number of pages reaches the number of pages to be printed, the control unit 31 determines that the printing of the final image has been terminated.

While the image forming operation in step S201 is executed, the control unit 31 repeats the discrimination process in step S202 until the printing of the final image is terminated (step S202: NO). On the other hand, if the printing of the final image has been terminated (step S202: YES), the control unit 31 advances the process to step S203.

[Step S203]

The control unit 31 executes a stopping process of the image forming operation. For example, the control unit 31 continuously controls the paper feed conveyance unit 32 and the paper discharge conveyance unit 35, and continues to convey the continuous paper P, on which the image is formed, to the paper discharging adjustment apparatus 40. Then, at the point of time when an end of the final image has passed through a position of a transfer roller T by a predetermined distance, the control unit 31 separates the transfer roller T from the continuous paper P. Subsequently, the control unit 31 at least controls the paper discharging adjustment apparatus 40, the processing apparatus 50, and the paper discharging apparatus 60 to perform a post-process, such as cutting off of the continuous paper P, on which the image is formed, into a predetermined shape, or lamination processing thereon. Eventually, the continuous paper P is rolled in a roll shape in the paper discharging apparatus 60. When the continuous paper P is wound to a position of the final image, the control unit 31 stops conveyance of the continuous paper P by the paper feed conveyance unit 32 and the paper discharge conveyance unit 35, and also stops conveyance of the continuous paper P in the paper discharging adjustment apparatus 40, the processing apparatus 50, and the paper discharging apparatus 60. After that, the control unit 31 releases a nip by the fixing roller R1 in the fixing unit 34. Together with this, the control unit 31 stops heating by the fixing roller R1 (turning off a heater).

[Step S204]

The control unit 31 discriminates whether the stopping process has been completed since the start of the stopping process of the image forming operation in step S203. For example, when the process to be performed finally (the process of turning off the heater of the fixing roller R1) is performed in the stopping process of the image forming operation, the control unit 31 determines that the stopping process of the image forming operation has been completed.

While the stopping process of the image forming operation in step S203 is executed, the control unit 31 repeats the discrimination process in step S204 until the stopping process of the image forming operation is completed (step S204: NO). On the other hand, if the stopping process of the image forming operation has been completed (step S204: YES), the control unit 31 terminates this printing process.

By executing the above-described printing process (step S102) in the image forming apparatus 30, the image based on the print target data can be formed on the continuous paper P. Further, after the printing of the final image (the image forming operation) is terminated, the stopping process of the image forming operation, such as turning off the heater of the fixing roller R1, is performed. Accordingly, an influence of heat from the fixing roller R1 to the continuous paper P can be reduced.

Next, the procedure of the process during stopping will be described with reference to FIGS. 5 to 7.

(Process During Stopping S103)

As mentioned above, when the process proceeds to step S103 of the printing request receiving process, the control unit 31 starts the process during stopping.

[Step S301]

When the process during stopping is started, the control unit 31 discriminates whether a condition of terminating the process during stopping (referred "termination condition C" hereinafter) is satisfied. (A) For example, the control unit 31 discriminates whether a temperature of the fixing roller R1 is at a predetermined temperature (e.g., 80° C.) or lower. (B) Also, the control unit 31 discriminates whether a total conveyance amount of the continuous paper P conveyed from the start of the process during stopping is a predetermined distance (e.g., 2000 mm) or more. If at least any of the above-described (A) and (B) conditions is satisfied, the control unit 31 determines that the termination condition C of the process during stopping is satisfied. It should be noted that in order to measure the temperature of the fixing roller R1, a general thermometer may be provided at the fixing roller R1. Further, in order to measure the conveyance amount of the continuous paper P, a rotary encoder may be used to detect a rotation amount of the rollers provided at the paper discharge conveyance unit 35 for conveying the continuous paper P.

If the control unit 31 determines that the termination condition C of the process during stopping is satisfied (step S301: YES), the control unit 31 terminates this process during stopping. On the other hand, if the control unit 31 determines that the termination condition C of the process during stopping is not satisfied (step S301: NO), the control unit 31 advances the process to step S302.

[Step S302]

The control unit 31 discriminates whether A seconds (e.g., 30 seconds) have passed since the start of the process during stopping. In other words, the control unit 31 discriminates whether A seconds have passed since the termination of the image forming operation on the final image. For example, the control unit 31 measures an elapsed time by counting the number of clocks of the CPU 71.

The control unit 31 repeats the discrimination process in step S302 until A seconds pass (step S302: NO). Meanwhile, the control unit 31 maintains a state in which the conveyance of the continuous paper P by the paper discharge conveyance unit 35 is stopped. On the other hand, if the control unit 31 determines that A seconds have passed (step S302: YES), the control unit 31 advances the process to step S303.

[Step S303]

The control unit 31 turns on the paper discharging motor for driving the paper discharge conveyance unit 35 and starts the conveyance of the continuous paper P. For example, the control unit 31 conveys the continuous paper P at a speed of 150 [mm/sec] (referred "periodic conveyance speed E" hereinafter) which is equal to the conveyance speed during the printing. It should be noted that the paper feed conveyance unit 32 may be driven simultaneously. In the present embodiment, an idling mechanism is provided at the rollers provided at the paper feed conveyance unit 32, and the continuous paper P is conveyed only by the paper discharge conveyance unit 35.

[Step S304]

The control unit 31 discriminates whether B seconds (e.g., 0.2 seconds) have passed since the start of the conveyance of the continuous paper P in step S303. For example, the control unit 31 measures an elapsed time by counting the number of clocks of the CPU 71.

The control unit 31 repeats the discrimination process in step S304 until B seconds pass (step S304: NO). Meanwhile, the control unit 31 continues the conveyance of the continuous paper P by the paper discharge conveyance unit 35. On the other hand, if the control unit 31 determines that B seconds have passed (step S304: YES), the control unit 31 advances the process to step S305.

[Step S305]

The control unit 31 turns off the paper discharging motor for driving the paper discharge conveyance unit 35 and stops the conveyance of the continuous paper P.

[Step S306]

The control unit 31 discriminates existence of a next printing request. Specifically, the control unit 31 performs a process similar to that in the abovementioned step S101.

If the control unit 31 determines that the next printing request does not exist (step S306: NO), the control unit 31 returns the process to step S301. With this configuration, while the next printing request does not exist and the termination condition C is not satisfied, the process in steps S302 to S305 is repeated. On the other hand, if the control unit 31 has received the next printing request (step S306: YES), the control unit 31 terminates this process during stopping.

By executing the above-described process during stopping (step S103) in the image forming apparatus 30, as illustrated in FIG. 6, the conveyance of the continuous paper P is performed for every predetermined period of time after the termination of the printing process (the image forming operation). In other words, the periodic conveyance, in which the conveyance is performed for B seconds after the stop of the conveyance for A seconds, is performed. By this conveyance, while the printing process (the image forming operation) is stopped, the continuous paper P can be conveyed in such a manner that the same portion of the continuous paper P does not remain in the fixing unit 34 for a predetermined period of time. As a result, the continuous paper P is conveyed before a certain amount or more of heat is applied from the fixing roller R1 to the same portion of the continuous paper P, and local thermal alteration is not generated on the continuous paper P.

Further, since the process during stopping is terminated if the termination condition C is satisfied, as illustrated in FIG. 7, the continuous paper P is not conveyed after the termination condition C is satisfied. In this way, since an upper limit is set to the conveyance amount of the continuous paper P by the periodic conveyance, the continuous paper P is not continuously conveyed endlessly, and the continuous paper P to be wasted can be reduced.

It should be noted that during the process during stopping, even if the printing request has been received at a timing other than step S306, the control unit 31 terminates the process during stopping and moves the process to the printing process (step S102). With this configuration, priority can be given to the printing request. However, if the next printing request has been received while the continuous paper P is conveyed in step S303 and step S304 (during the conveyance for B seconds), the control unit 31 may move the process to the printing process (step S102) after finishing the conveyance.

It should be noted that the respective process units of the above-described flowcharts are divided according to main process contents in order to facilitate understanding of the image forming system 1. The claimed invention is not limited by classification manners of the process steps or names thereof. The process performed in the image forming system 1 can be divided into further more process steps. Moreover, the one process step may execute further more processes.

<Variant Examples>

Further, the above-described embodiment is intended to exemplify a gist of the present invention and is not intended to limit the present invention. Many alternatives, modifications, and variations are apparent to those skilled in the art.

For example, in the above-described embodiment, as illustrated in FIG. 6, the conveyance of the continuous paper P is periodically (intermittently) implemented after the termination of the printing process (the image forming operation). However, while the printing process is stopped, if the continuous paper P can be conveyed in such a manner that the same portion thereof does not remain in the fixing unit 34 for a predetermined period of time, the present invention is not limited to this.

Figure 8:
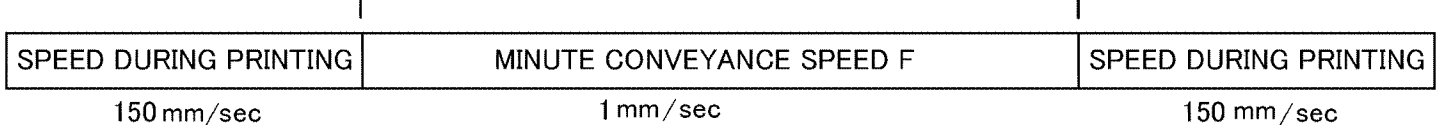
FIG. 8 is a diagram for explaining about a variant example of a conveying method of a continuous paper in a process during stopping.

FIG. 8 is a diagram for explaining about a variant example of a conveying method of a continuous paper in a process during stopping. For example, instead of periodically implementing the conveyance of the continuous paper P, as illustrated in FIG. 8, a continuous paper P may be continuously conveyed at a very slow constant speed (referred "minute conveyance speed F") compared to a conveyance speed during printing. For example, in contrast with the conveyance speed during the printing of 150 mm/sec, the minute conveyance speed F is set to 1 mm/sec.

By this conveyance method, in the same way as the above-described embodiment, while the printing process (the image forming operation) is stopped, the continuous paper P can be conveyed in such a manner that the same portion of the continuous paper P does not remain in a fixing unit 34 for a predetermined period of time. As a result, the continuous paper P is conveyed before a certain amount or more of heat is applied from a fixing roller R1 to the same portion of the continuous paper P, and local thermal alteration is not generated.

Further, a conveyance amount of the continuous paper P may be changed according to an elapsed time from a termination of the printing process. In other words, since a temperature of the fixing unit 34 lowers as the elapsed time from the termination of the printing process is longer, the conveyance amount of the continuous paper P by the periodic conveyance illustrated in FIG. 6 may be reduced according to the elapsed time from the termination of the printing process.

Moreover, in the above-described embodiment and the variant examples, a position of the fixing roller R1 while the printing process (the image forming operation) is stopped is not referred to in detail.

Figure 9:
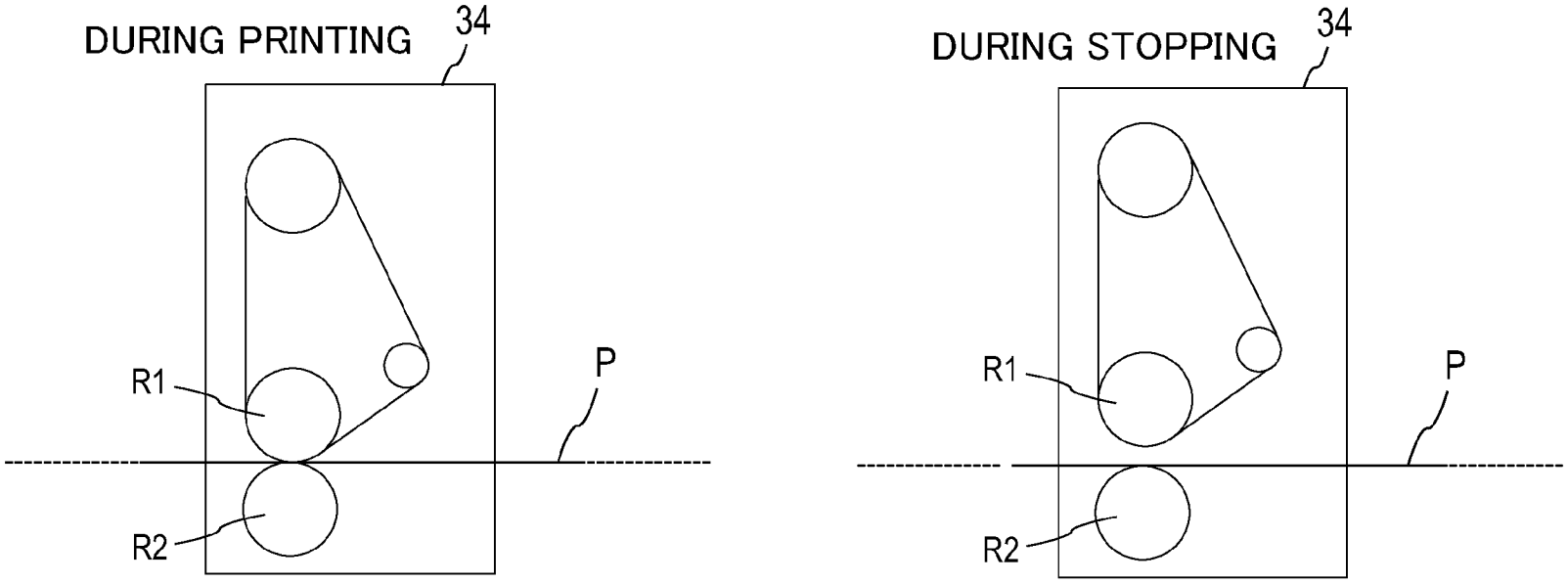
FIG. 9 is a diagram illustrating an example of a position of a fixing roller while a printing process is stopped.

FIG. 9 is a diagram illustrating an example of a position of a fixing roller. For example, during the printing process, as illustrated in a left figure in FIG. 9, the control unit 31 causes the fixing roller R1 to abut the continuous paper P and fix an image to the continuous paper P by applying pressure. However, in the process during stopping, as illustrated in a right figure in FIG. 9, the control unit 31 releases the abutment (or the nip) of the fixing roller R1, and separates the fixing roller R1 from the continuous paper P. With this configuration, heat of the fixing roller R1 is hardly transmitted to the continuous paper P, and thermal alteration of the continuous paper P can be prevented more effectively by using in combination with the conveyance method in the process during stopping in the above-described embodiment or the variant examples.

In the example illustrated in the right figure in FIG. 9, it is preferable that the fixing roller R1 be rotatable in a state in which the abutment (or the nip) is released.

Further, in the above-described embodiment, after the stop of the printing process (the image forming operation), the control unit 31 stops the heating by the fixing roller R1 in step S203. However, the present invention is not limited to this. Instead of stopping the heating, the control unit 31 may adjust a temperature of the fixing roller R1 by lowering the temperature to a target temperature.

Moreover, the conveyance method (at least one of the following x1 to x4) of the continuous paper P in the process during stopping may be changed according to at least any of a type and a basis weight of the continuous paper P.

(x1) For example, the time interval (A seconds illustrated in FIGS. 6 and 7) of periodically conveying the continuous paper Pin the process during stopping may be changed according to at least any of the type and the basis weight of the continuous paper P. Specifically, the time interval is 30 seconds in a case of using a plain paper which is weak to heat, the time interval is 60 seconds in a case of using a glossy paper which is slightly strong against heat, and the periodic conveyance is not implemented in a case of using a heat-resistant paper which is strong against heat. Here, numerical values, such as 30 seconds and 60 seconds, are merely examples, and different time intervals may be applied.

(x2) Further, for example, the termination condition C of the process during stopping may be changed according to at least any of the type and the basis weight of the continuous paper P. Specifically, when the continuous paper P which is strong against heat is used, an upper limit of the total conveyance amount of the continuous paper P conveyed after the start of the process during stopping is lowered.

(x3) Further, for example, the periodic conveyance speed E of the continuous paper P during the process during stopping may be changed according to at least any of the type and the basis weight of the continuous paper P.

(x4) Further, for example, the temperature of the fixing unit 34 (the fixing roller R1) which is maintained (adjusted) after the stop of the image forming operation (during the process during stopping) may be changed according to at least any of the type and the basis weight of the continuous paper P. Specifically, the fixing unit 34 is maintained at "80° C." in a case of using the plain paper, is maintained at "100° C." in a case of using the glossy paper, and is maintained at "120° C." in a case of using the heat-resistant paper. Here, numerical values, such as 80° C., 100° C., and 120° C., are merely examples, and different temperatures may be applied.

Further, the conveyance speeds (the periodic conveyance speed E illustrated in FIG. 6, the minute conveyance speed F illustrated in FIG. 8) of the continuous paper P during the process during stopping may be changed according to the temperature of the fixing unit 34 (the fixing roller R1).

Further, in the above-described embodiment, "the temperature of the fixing roller R1 is lowered to the predetermined temperature" is cited as one of the termination conditions C of the process during stopping. However, the present invention is not limited to this. With a lapse of a predetermined period of time since the start of the process during stopping as the termination condition C, the control unit 31 may terminate the process during stopping (the periodic conveyance of the continuous paper P illustrated in FIG. 6, or the continuous conveyance illustrated in FIG. 8). Moreover, with the elapse of the predetermined period of time since the start of the process during stopping as the termination condition C, the time interval (A seconds illustrated in FIGS. 6 and 7) of periodically conveying the continuous paper P may be increased.

Further, in the process during stopping, the control unit 31 may convey the continuous paper P by switching the conveyance direction of the continuous paper P between a feeding direction (forward direction) of the continuous paper P at the time of image formation by the image forming unit 33 and a direction reverse to the feeding direction. With this configuration, the continuous paper P is not continuously conveyed in one direction endlessly, and the continuous paper P to be wasted can be reduced. In the case of conveying the continuous paper P in the reverse direction, it is preferable that the paper feeding conveyance rollers in the paper feed conveyance unit 32 be rotated in a direction reverse to the forward direction.

Further, in the above-described embodiment and the respective variant examples, in the process during stopping, the continuous paper P is conveyed by the configuration which is not included in the fixing unit 34 (e.g., the paper discharge conveyance unit 35). However, the present invention is not limited to this. The continuous paper P may be conveyed by the fixing roller R1 and the pressurizing roller R2 of the fixing unit 34.

Further, when the conveyance of the continuous paper P is controlled by the control unit 31, a cooling unit (e.g., a fixing fan) for cooling the continuous paper P may be provided in the fixing unit 34. With this configuration, since the temperature of the fixing roller R1 is lowered immediately after the termination of the printing process (the image forming operation), an implementation period of the process during stopping is shortened and the conveyance amount of the continuous paper P is reduced. As a result, the continuous paper P to be wasted can be reduced.

Main components of the above-described configuration of the image forming system 1 have been described in describing features of the above-described embodiment and the respective variant examples, and the configuration thereof is not limited to the above-described configuration. Moreover, it is not intended to exclude a configuration provided at a general image forming system 1.

Further, the above-described processes of the control unit 31 can be achieved also by an exclusive hardware circuit. In this case, the processes may be executed by single hardware or may be executed by a plurality of hardware.

Further, the program for operating the image forming system 1 may be provided by a computer readable recording medium, such as a USB memory, a flexible disk, or a CD-ROM, or may be provided online via a network, such as the Internet. In this case, the program recorded on the computer readable recording medium is usually transferred to and stored in the memory 72, the storage 73, or the like. Moreover, this program, for example, may be provided as single application software, or may be incorporated into software as one function of the image forming system 1.

The entire disclosure of Japanese Patent Application No. 2013-190983 filed on Sep. 13, 2013 including specification, claims, drawings and summary are incorporated herein by reference in its entirety.

What is claimed is:

1. An image forming apparatus comprising:

an image forming unit configured to form an image on a continuous paper;

a fixing unit configured to fix the image formed on the continuous paper by heat;

a plurality of conveyance units configured to convey the continuous paper in a predetermined conveying direction for an image forming operation by the image forming apparatus; and a control unit configured to, throughout a period from completion of conveyance of the continuous paper for a previous image forming operation to start of conveyance of the continuous paper for a next image forming operation, control the plurality of conveyance units to convey the continuous paper only in the predetermined conveying direction in such a manner that positioning of a same portion of the continuous paper, on which the image is not formed, in the fixing unit for more than a predetermined period of time is avoided, wherein the control unit continuously conveys the continuous paper throughout the period from the completion of conveyance of the continuous paper for the previous image forming operation to the start of conveyance of the continuous paper for the next image forming operation, and wherein the control unit controls the conveyance units to stop conveying the continuous paper, when a temperature of the fixing unit is equal to or less than a predetermined temperature while continuously conveying the continuous paper.

2. The image forming apparatus as claimed in claim 1, wherein the fixing unit has a roller which abuts the continuous paper and fixes the image to the continuous paper by applying pressure, and the abutment of the roller is released after stopping of the image forming operation by the image forming apparatus.

3. The image forming apparatus as claimed in claim 2, wherein the roller is rotated in a state in which the abutment of the roller on the continuous paper is released.

4. The image forming apparatus as claimed in claim 1, wherein after stopping of the image forming operation by the image forming apparatus, the fixing unit stops heating or adjusts a temperature by lowering to a target temperature.

5. The image forming apparatus as claimed in claim 1, wherein the control unit changes at least one of a conveyance speed of the continuous paper, and a temperature of the fixing unit after stopping of the image forming operation according to at least one of a type and a basis weight of the continuous paper.

6. The image forming apparatus as claimed in claim 1, wherein the plurality of conveyance units convey the continuous paper by a configuration which is not included in the fixing unit.

7. The image forming apparatus as claimed in claim 1, further comprising a cooling unit configured to cool the continuous paper in the fixing unit, when the conveyance of the continuous paper is controlled by the control unit.

8. The image forming apparatus as claimed in claim 1, wherein the predetermined temperature is a temperature at which local thermal alteration on the continuous paper is not generated.

9. An image forming system comprising:

an image forming apparatus comprising:

an image forming unit configured to form an image on a continuous paper;

a fixing unit configured to fix the image formed on the continuous paper by heat;

a plurality of conveyance units configured to convey the continuous paper in a predetermined conveying direction for an image forming operation by the image forming apparatus; and a control unit configured to, throughout a period from completion of conveyance of the continuous paper for a previous image forming operation to start of conveyance of the continuous paper for a next image forming operation, control the plurality of conveyance units to convey the continuous paper only in the predetermined conveying direction in such a manner that positioning of a same portion of the continuous paper, on which the image is not formed, in the fixing unit for more than a predetermined period of time is avoided, wherein the control unit continuously conveys the continuous paper throughout the period from the completion of conveyance of the continuous paper for the previous image forming operation to the start of conveyance of the continuous paper for the next image forming operation;

a paper feeding apparatus configured to feed the continuous paper to the image forming apparatus;

a paper discharging apparatus configured to discharge the continuous paper, on which the image is formed, from the image forming apparatus;

a paper feeding adjustment apparatus configured to adjust feeding of the continuous paper in order to absorb a conveyance speed difference of the continuous paper between the paper feeding apparatus and the image forming apparatus; and a paper discharging adjustment apparatus configured to adjust discharging of the continuous paper in order to absorb a conveyance speed difference of the continuous paper between the paper discharging apparatus and the image forming apparatus.

10. The image forming system as claimed in claim 9, further comprising:

a processing apparatus configured to perform predetermined processing on the continuous paper conveyed from the paper discharging adjustment apparatus and to convey the processed continuous paper to the paper discharging apparatus.

11. The image forming system as claimed in claim 9, wherein the fixing unit has a roller which abuts the continuous paper and fixes the image to the continuous paper by applying pressure, and the abutment of the roller is released after stopping of the image forming operation by the image forming apparatus.

12. The image forming system as claimed in claim 11, wherein the roller is rotated in a state in which the abutment of the roller on the continuous paper is released.

13. The image forming system as claimed in claim 9, wherein after stopping of the image forming operation by the image forming apparatus, the fixing unit stops heating or adjusts a temperature by lowering to a target temperature.

14. The image forming system as claimed in claim 9, wherein the control unit changes at least one of a conveyance speed of the continuous paper, and a temperature of the fixing unit after stopping of the image forming operation according to at least one of a type and a basis weight of the continuous paper.

15. The image forming system as claimed in claim 9, wherein, after the completion of conveyance of the continuous paper for the previous image forming operation, the control unit stops conveyance of the continuous paper when one of:

(i) a temperature of the fixing unit is lowered to a predetermined temperature at which the heat of the fixing unit does not generate local thermal alteration on the continuous paper, and (ii) a predetermined period of time has elapsed so that the heat of the fixing unit does not generate local thermal alteration on the continuous paper.

16. The image forming system as claimed in claim 9, wherein the plurality of conveyance units convey the continuous paper by a configuration which is not included in the fixing unit.

17. The image forming system according to claim 9, further comprising a cooling unit configured to cool the continuous paper in the fixing unit, when the conveyance of the continuous paper is controlled by the control unit.

18. An image forming method in an image forming apparatus including an image forming unit configured to form an image on a continuous paper, a fixing unit configured to fix the image formed on the continuous paper by heat, and a plurality of conveyance units configured to convey the continuous paper in a predetermined conveying direction for an image forming operation by the image forming apparatus, the method comprising:

determining whether or not the image forming operation by the image forming apparatus is stopped between completion of conveyance of the continuous paper for a previous image forming operation and start of conveyance of the continuous paper for a next image forming operation; and when it is determined that the image forming operation is stopped, throughout a period from the completion of conveyance of the continuous paper for the previous image forming operation to the start of conveyance of the continuous paper for the next image forming operation:

controlling the plurality of conveyance units to convey the continuous paper only in the predetermined conveying direction in such a manner that positioning of a same portion of the continuous paper, on which the image is not formed, in the fixing unit for more than a predetermined period of time is avoided, wherein the continuous paper is continuously conveyed throughout the period from the completion of conveyance of the continuous paper for the previous image forming operation to the start of conveyance of the continuous paper for the next image forming operation; and controlling the conveyance units to stop conveying the continuous paper, when a temperature of the fixing unit is equal to or less than a predetermined temperature while continuously conveying the continuous paper.

19. The image forming method as claimed in claim 18, wherein the fixing unit has a roller which abuts the continuous paper and fixes the image to the continuous paper by applying pressure, and wherein the method further comprises releasing the abutment of the roller after stopping of the image forming operation by the image forming apparatus.

20. The image forming method as claimed in claim 18, further comprising stopping heating in the fixing unit or adjusting a temperature by lowering to a target temperature after stopping of the image forming operation by the image forming apparatus.

21. The image forming method as claimed in claim 18, wherein at least one of a conveyance speed of the continuous paper, and a temperature of the fixing unit after stopping of the image forming operation is changed according to at least one of a type and a basis weight of the continuous paper.

22. A non-transitory computer readable recording medium having stored thereon an image forming program for a computer of an image forming apparatus including an image forming unit configured to form an image on a continuous paper, a fixing unit configured to fix the image formed on the continuous paper by heat, and a plurality of conveyance units configured to convey the continuous paper in a predetermined conveying direction for an image forming operation by the image forming apparatus, the program causing the computer to perform functions comprising:

determining whether or not the image forming operation by the image forming apparatus is stopped between completion of conveyance of the continuous paper for a previous image forming operation and start of conveyance of the continuous paper for a next image forming operation; and when it is determined that the image forming operation is stopped, throughout a period from the completion of conveyance of the continuous paper for the previous image forming operation to the start of conveyance of the continuous paper for the next image forming operation:

controlling the plurality of conveyance units to convey the continuous paper only in the predetermined conveying direction in such a manner that positioning of a same portion of the continuous paper, on which the image is not formed, in the fixing unit for more than a predetermined period of time is avoided, wherein the continuous paper is continuously conveyed throughout the period from the completion of conveyance of the continuous paper for the previous image forming operation to the start of conveyance of the continuous paper for the next image forming operation; and controlling the conveyance units to stop conveying the continuous paper, when a temperature of the fixing unit is equal to or less than a predetermined temperature while continuously conveying the continuous paper.

23. The non-transitory computer readable recording medium as claimed in claim 22, wherein the fixing unit has a roller which abuts the continuous paper and fixes the image to the continuous paper by applying pressure, and wherein the program further causes the computer to perform a function comprising releasing the abutment of the roller after stopping of the image forming operation by the image forming apparatus.

24. The non-transitory computer readable recording medium as claimed in claim 22, wherein the program further causes the computer to perform a function comprising stopping heating in the fixing unit or adjusting a temperature by lowering to a target temperature after stopping of the image forming operation by the image forming apparatus.

25. The non-transitory computer readable recording medium as claimed in claim 22, wherein at least one of a conveyance speed of the continuous paper, and a temperature of the fixing unit after stopping of the image forming operation is changed according to at least one of a type and a basis weight of the continuous paper.

26. An image forming apparatus comprising:

an image forming unit configured to form an image on a continuous paper;

a fixing unit configured to fix the image formed on the continuous paper by heat;

a plurality of conveyance units configured to convey the continuous paper in a predetermined conveying direction for an image forming operation by the image forming apparatus; and a control unit configured to, throughout a period from completion of conveyance of the continuous paper for a previous image forming operation to start of conveyance of the continuous paper for a next image forming operation, control the plurality of conveyance units to convey the continuous paper only in the predetermined conveying direction in such a manner that positioning of a same portion of the continuous paper, on which the image is not formed, in the fixing unit for more than a predetermined period of time is avoided, wherein the control unit continuously conveys the continuous paper throughout the period from the completion of conveyance of the continuous paper for the previous image forming operation to the start of conveyance of the continuous paper for the next image forming operation, and wherein the control unit controls the conveyance units to stop conveying the continuous paper, when a conveyance amount of the continuous paper is equal to or longer than a predetermined length, after the completion of conveyance of the continuous paper for the previous image forming operation.

27. The image forming apparatus as claimed in claim 26, wherein the predetermined length is a length such that the continuous paper is conveyed for a period of time until a temperature of the fixing unit reaches a temperature at which local thermal alteration on the continuous paper is not generated.

28. The image forming apparatus as claimed in claim 26, wherein the fixing unit has a roller which abuts the continuous paper and fixes the image to the continuous paper by applying pressure, and the abutment of the roller is released after stopping of the image forming operation by the image forming apparatus.

29. The image forming apparatus as claimed in claim 28, wherein the roller is rotated in a state in which the abutment of the roller on the continuous paper is released.

30. The image forming apparatus as claimed in claim 26, wherein after stopping of the image forming operation by the image forming apparatus, the fixing unit stops heating or adjusts a temperature by lowering to a target temperature.

31. The image forming apparatus as claimed in claim 26, wherein the control unit changes at least one of a conveyance speed of the continuous paper, and a temperature of the fixing unit after stopping of the image forming operation according to at least one of a type and a basis weight of the continuous paper.

32. The image forming apparatus as claimed in claim 26, wherein the plurality of conveyance units convey the continuous paper by a configuration which is not included in the fixing unit.

33. The image forming apparatus as claimed in claim 26, further comprising a cooling unit configured to cool the continuous paper in the fixing unit, when the conveyance of the continuous paper is controlled by the control unit.

* * * * *